US005868430A

United States Patent [19]

Kolosvary

[11] Patent Number: 5,868,430

[45] Date of Patent: Feb. 9, 1999

[54] STAND-ALONE CLOSE-PROXIMITY, RE-USABLE RETAIL PRODUCT INFORMATION TAG

[76] Inventor: Judy Kolosvary, 2034 Mount Shasta Dr., San Pedro, Calif. 90732

[21] Appl. No.: 813,926

[22] Filed: Mar. 7, 1997

[51] Int. Cl.[6] ..... B42D 15/00

[52] U.S. Cl. ..... 283/80; 283/74; 283/75

[58] Field of Search ..... 283/80, 74, 75

[56] References Cited

U.S. PATENT DOCUMENTS

| | | | |
|---|---|---|---|
| 1,558,780 | 10/1925 | Betham | 283/80 |
| 3,788,540 | 1/1974 | Sammons | 283/80 |
| 5,261,176 | 11/1993 | David et al. | 283/74 |
| 5,476,289 | 12/1995 | Hoyt et al. | 283/80 |
| 5,599,052 | 2/1997 | Van Davelaar | 283/75 |

*Primary Examiner*—Daniel W. Howell
*Assistant Examiner*—Adesh Bhargava

[57] ABSTRACT

An information and pricing device which is quick and easy-to-affix, easy-to-remove, and is re-usable. It provides information and/or price to any dimensional item whereas the price or information appears on the body (10), while the slit (12) snaps over the product. The product remains in place in the hole (14) and is held in place by the top loop (16). The entire tag can be cut, formed or die cut from a thin, flat, flexible material, any material which allows the tag to be snapped onto and off of a product without breaking. In addition, the tag stays close to the product to which it is attached, hangs neatly and predictably from the product, does not require an additional apparatus or device to affix it, is available in any color, allows for viewing from either side of the product, is inexpensive to produce, is automatically collated in price-order, requires just a quick motion to affix or remove from a product, is re-usable and leaves no residue.

16 Claims, 4 Drawing Sheets

STAND-ALONE CLOSE-PROXIMITY, RE-USABLE RETAIL PRODUCT INFORMATION TAG

BACKGROUND

1. Field of Invention

Figure 1A:
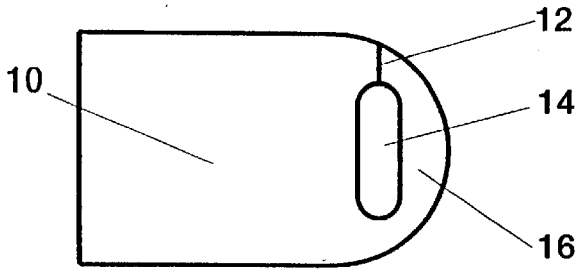

This invention relates to price and information devices, specifically for retail point-of-purchase aids.

2. Discussion of Prior Art

All products in a retail store environment require an informational or price "tag" to provide information to consumers about a product. Pricing information, in addition to other information, such as "Sale", "Best Value", "Special", "Just", "Now", warranty information, features and benefits, material, type or style, size, instructions or directions, etc. can all prove to be helpful to the consumer.

Existing devices take a tremendous quantity of time and require significant manipulation to affix to the product, are very difficult to remove from the product once applied, are not removable at all, are not re-usable once removed, are very expensive to produce, are not easily visible from either side, cannot be affixed to both sides, or simply do not work with certain types of products.

In the case of jewelry, and many other dimensional or rounded products, existing price/information devices suffer from a number of disadvantages:

a) Adhesive-back devices may not, or will not, work with certain products (i.e. jewelry, giftware, accessories, etc.) and hide important information in cases where they will work. (Many companies produce adhesive-back labels and tags.)

b) "String tags", Jewelry Tags, Lock-on Tags, Sale Tags, Inventory Tags, Reusable Tags, Duratags, etc. (marketed by many companies, including Avery-Dennison Corporation, Arch Crown, Inc., D & G Sign and Label, Ready Made division of Cornerstone Direct Corporation, Seton Nameplate Company, Interstate Label Company, etc.) are extremely difficult and time consuming to affix to, and remove from, a product (i.e. a ring or a necklace), taking a considerable amount of manipulation, number of movements and time. This is especially critical when tagging/retagging a large number of items.

c) The necessary length of string in String Tags allows the tag to lay far away from the specific product to which it relates, in most cases laying closer to a different product.

d) String tags are cost prohibitive to print 2-sided. Consequently the pricing or information cannot be read by the consumer if the tag is laying face down (happens often) and it is difficult and time-consuming to ensure that they lay face up.

e) When a series of different price points are produced at the same time, it is difficult, extremely time-consuming and expensive to sort into sequential order, making it very difficult and time consuming to locate the proper price tag for a specific product.

f) If a multitude of items are arranged together (for example in a ring tray) and bear a string tag, the display becomes very sloppy and messy as strings and tickets are strewn everywhere.

g) Plastic Eyelet tags and Button-fast tags (marketed by Arch Crown, Inc., D & G Sign and Label, Interstate Label, etc.) are labor-intensive to affix, are not removable (without destroying the tag or label), are expensive to produce and are not pre-sorted in price order.

h) For watches, Slip-on tags (Arch Crown, Inc.) will not work with bracelet-style (closed band) watches, requiring additional tag styles to be inventoried.

i) Tags with plastic Lock Ties (Arch Crown, Inc., Interstate Label, D & G Sign & Label, etc.) are difficult and time consuming to apply, are not removable, and are expensive.

j) Pressure Sensitive String tags, Pressure sensitive tags with Adhesive-free shanks, Tag-ware tags and Computer tags are not predictable as to how they fall or lay next to the product. They cannot be removed without destroying the tag and thus cannot be re-used. By their very design, they lay in such a manner that they cannot be viewed or read easily.

k) Other adhesive-style price/information tags are sloppy because their placement is unpredictable, they are not re-usable, are difficult to remove, and leave a sticky residue on the product when they are removed.

l) Jewelry tag marking device U.S. Pat. No. 4,397,208 (1979) Stalhut is a tag for marking pricing on jewelry but consists of a completely different configuration and operation.

m) Auto Key Ring Tag, U.S. Pat. No. 5,104,148 (1991) Neal, serves as an identification tag, but is adhesive-backed, not re-usable, and specifically related to automotive key identification.

n) Placard for Curved Objects U.S. Pat. No. 5,564,207 (1994) Wagner is specifically designed for curved objects but is not of a similar configuration or purpose.

o) Several types of thin, flat closures have been proposed—for example in U.K. patent 883,771 to Britt et al. (1961) and U.S. Pat. Nos. 3,164,250 (1965), 3,417,912 (1968), 3,822,441 (1974), 4,361,935 (1982), and 4,509,231 (1985) all to Paxton; all have their primary purpose as a closure, not as providing pricing or information. This Price and Information device is not intended for use as a closure, but rather to provide pricing and information in a logical, easy-to-read manner, in close proximity to the product.

OBJECTS AND ADVANTAGES

Accordingly, several objects and advantages of my invention are:

a) Easy to affix to a product;

b) Easy to remove from a product . . . especially beneficial when tagging hundreds of items in a store, when trying on a product, (a ring for example) when prices require changing, when taking inventory, when re-tagging for special events, or when an item is sold;

c) Re-usable after being removed;

d) Information appears in close proximity to the product it describes;

e) Inexpensive to produce;

f) Cost-effective to produce 2-sided to provide greater visibility and flexibility;

g) Designed so that Pricing or Information appears close to the product to which it relates;

h) Information can be easily seen and read from either side of the product, its configuration enhances easy viewing;

i) Comes pre-sorted in sequential order making it quick and simple to locate the correct price/information for the product, cutting time and cost;

j) Is neat, as the direction and orientation on how the tag will lay is predictable;

k) Does not require special apparatus or devices to affix;

l) Leaves no residue on the product;

m) Can be printed any color ink on any color stock, and any material having desired qualities;

n) Can be seen and read equally well from either side of the product;

o) Is universal in size and works with a wide range of products equally well, (i.e. works with all styles of watches), also reducing inventory of price tags/information devices;

p) The information will not cover up other important information on the product's label.

Further objects and advantages of this device or tag are to provide a pricing/information device which is very simple, inexpensive to produce, requires just one quick motion to attach or remove, lends itself to any dimensional product which it can fit around, through or on, can be produced in any variety of colors and shapes, and saves a tremendous amount of affixing and removal time which results in further cost savings. In addition they come pre-sorted in order which saves further time and cost. Still further objects and advantages will become apparent from a consideration of the drawings and ensuing description.

BRIEF DESCRIPTION OF FIGS. 1–8

FIG. 1*a* is a top view that shows the key components being a main body, area, section, or plane (10), a slit, cut, slot, slice, access gate, opening, passage or separation (12), a hole, cavity, opening, cutout, or punch-out (14), and a top loop, hook, arch, cap, crest, dome, finger or arm (16) created by said hole.

Figure 1B:
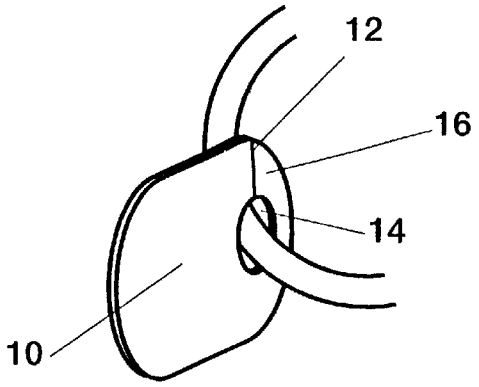

FIG. 1*b* is a dimensional view of the tag in place on an object or product with a round hole.

Figure 2A:
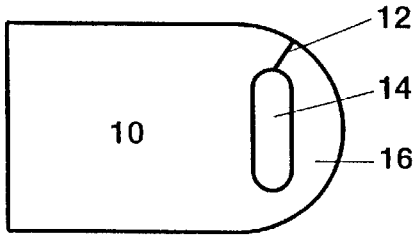

FIG. 2*a* shows a first variation of a non-round hole shape and a first slit variation.

Figure 2B:
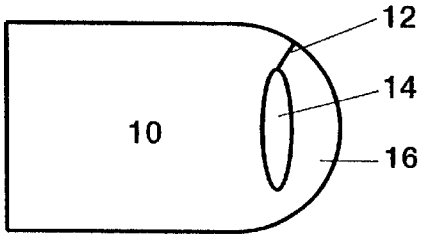

FIG. 2*b* shows a second variation of a non-round hole shape and a second slit variation.

Figure 2C:
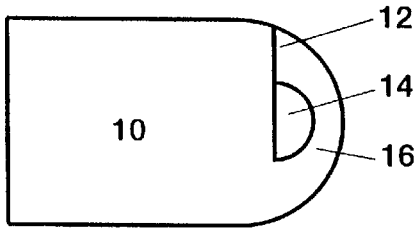

FIG. 2*c* shows a third variation of a non-round hole shape and a third slit variation.

Figure 2D:
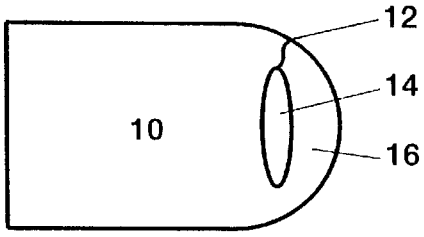

FIG. 2*d* shows a fourth variation of a non-round hole shape and a fourth slit variation.

Figure 2E:
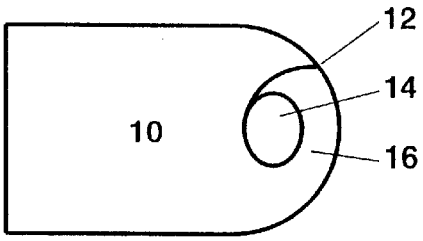

FIG. 2*e* shows a fifth variation of a non-round hole shape and a fifth slit variation.

Figure 3A:
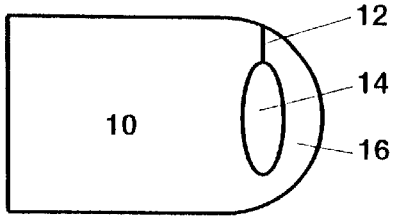

FIG. 3*a* shows a first variation of an oval hole shape and a first straight slit variation.

Figure 3B:
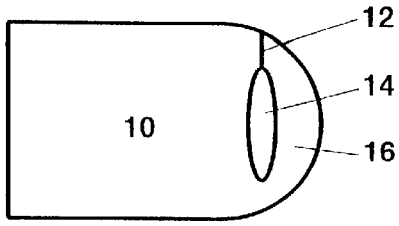

FIG. 3*b* shows a second variation of an oval hole shape and a second straight slit variation.

Figure 4A:
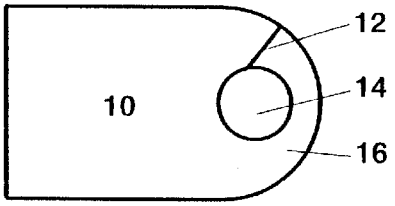

FIG. 4*a* shows a first variation of a round hole shape and a first straight slit variation.

Figure 4B:
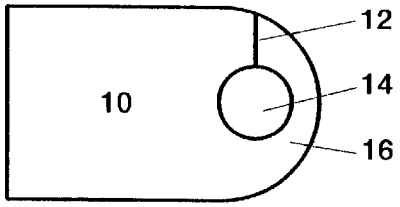

FIG. 4*b* shows a second variation of a round hole shape and a first slanted slit variation.

Figure 5A:
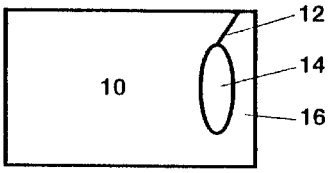

FIG. 5*a* shows a first variation of a tag shape and a first hole variation.

Figure 5B:
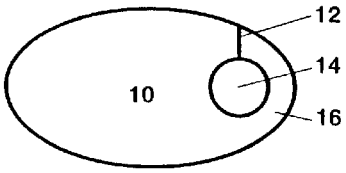

FIG. 5*b* shows a second variation of a tag shape and a second hole variation.

Figure 5C:
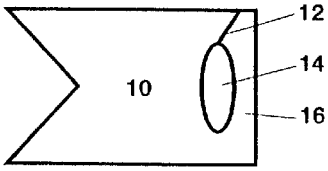

FIG. 5*c* shows a third variation of a tag shape and a third hole variation.

Figure 5D:
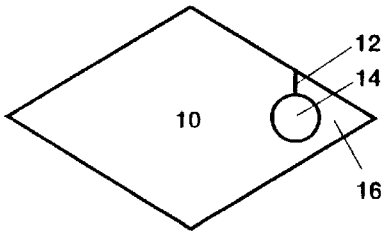

FIG. 5*d* shows a fourth variation of a tag shape and a fourth hole variation.

Figure 5E:
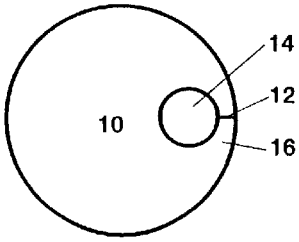

FIG. 5*e* shows a fifth variation of a tag shape and a fifth hole variation.

Figure 5F:
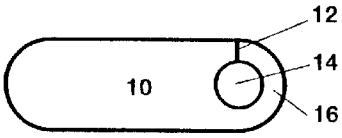

FIG. 5*f* shows a sixth variation of a tag shape and a sixth hole variation.

| Reference Numerals in Drawings | |
|---|---|
| 10 Main Body<br>. . . place where Price and/or Information appears | 18 Die Line<br>. . . outside cut or shape configuration |
| 12 Slit<br>. . . allows product to pass to hole | 20 Price Points<br>. . . as printed in price order on the sheet |
| 14 Hole<br>. . . which fits over, around or through a product | 22 8½" × 14" Standard Sheet Size<br>. . . with 154 tags in place |
| 16 Top Loop<br>. . . or hook created by hole, which helps keep the tag in place | |

SUMMARY

My price/information device is easy to affix and easy to remove from a product. It is reusable and leaves no residue, is inexpensive to produce, even 2-sided, requires no additional or separate device or apparatus for applying, and is easy to read and relate to the specific product to which it belongs from either side of the product. Because they are produced on a single sheet in price order, the correct price is easy to locate.

Description—FIGS. 1 to 8

FIG. 1*a* shows a top view and 1*b* a dimensional view of my device showing the key components being a main body, area, section, or plane (10), a slit, cut, slot, slice, access gate, opening, passage or separation (12), a hole, cavity, opening, cutout, or punch-out (14), and a top loop, hook, arch, cap, crest, dome, finger or arm (16) created by said hole.

FIG. 2*a* through 2*e* shows a top view with some of many possible non-round hole shape (14) possible, and some of many slit (12) variations possible.

FIG. 3*a* and 3*b* show oval hole (14) shape variations with a straight slit (12).

FIG. 4 shows a top view with the round hole (14) shape, with 4*a* showing a diagonal slit (12) and 4*b* showing a straight slit (12).

FIG. 5*a* through 5*f* shows top views of some of many overall tag shape main body (10) variations possible, plus some of many possible hole shapes (14), and slit (12) variations possible.

Figure 6:
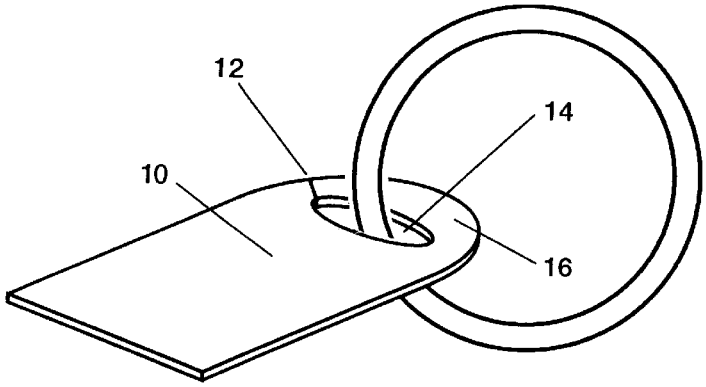

FIG. 6 shows a perspective view of my device, which can be constructed of any thin, flexible material. It is shown in place on a diamond ring where the shank of said ring is in the hole (14), and information, a "$", is indicated on the main body (10).

Figure 7:
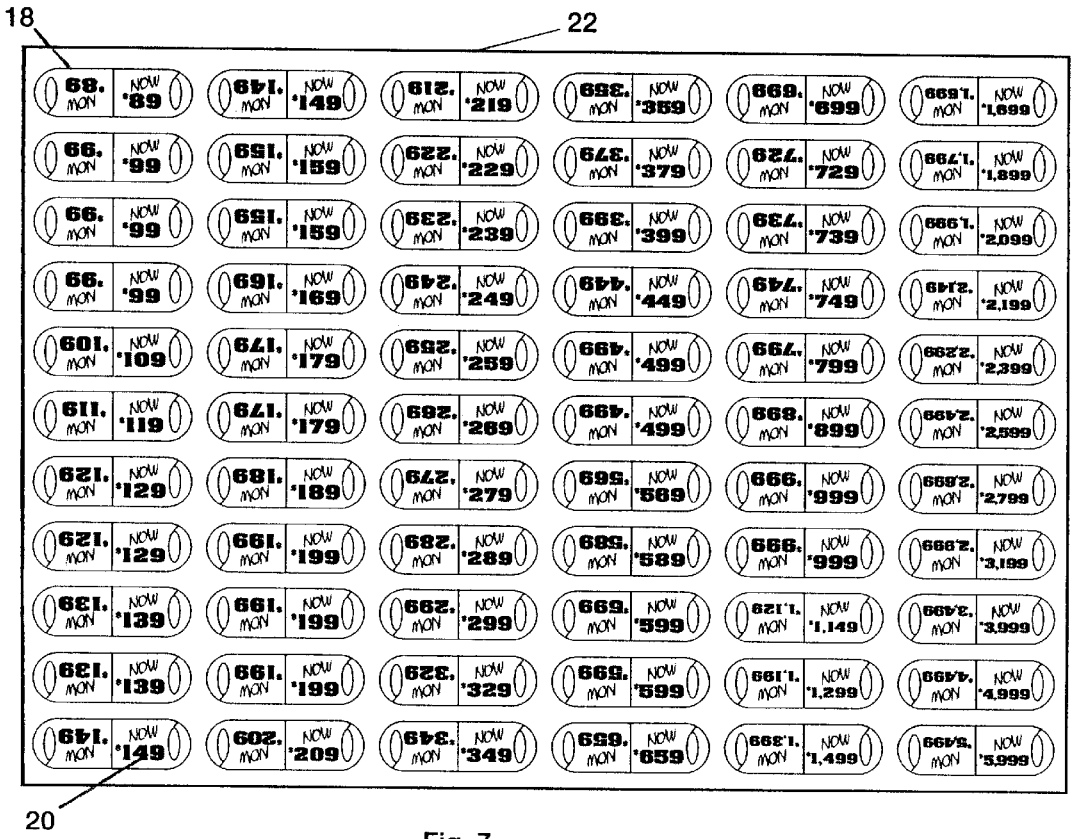

FIG. 7 shows die line (18) and pricing information (20) in place. The sheet (22) is a standard 8½"×14" size with 154 tags on a single sheet. The pricing information (20) is set up in price-order sequence for easy identification and location of correct price points.

Figure 8:
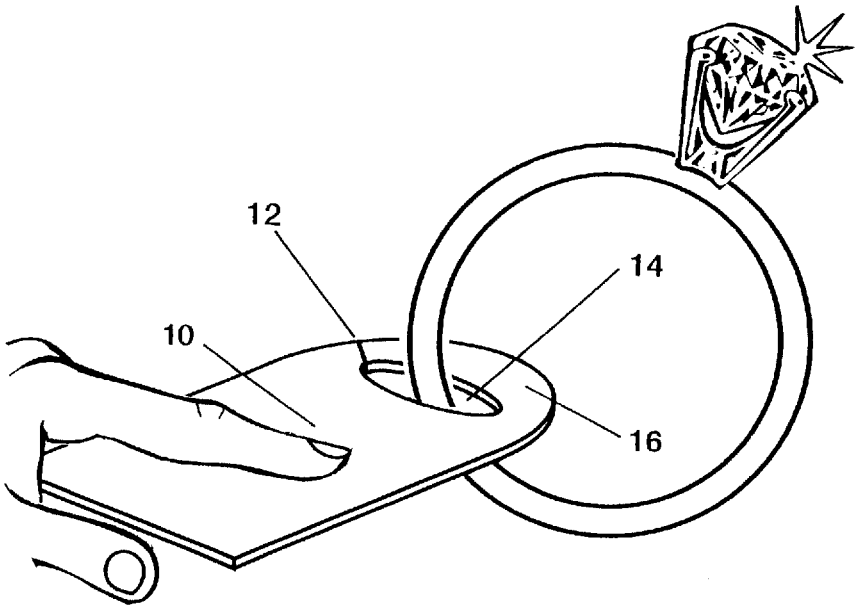

FIG. 8 shows how a tag is applied to a product, being held by main body (10) next to a product (in this example a diamond ring), the shank of the ring passes through the slit (12) and sits in the hole (14).

Operation—FIG. 1 to 8

As shown in FIG. 8, the manner of using the price/information tag for jewelry is to simply hold a product, (a diamond ring in this case), in one hand. In the other hand, one simply holds the main body (10) of the price tag between index finger and thumb, placing top loop (16) of the tag against shank of the ring. Then, one moves the tag toward the ring until diamond ring slips through the slit (12). The top loop (16) snaps around shank of ring holding the ring in place, and the shank of ring is remains in the hole (14). The tag is now affixed, and ring can be placed in ring tray, box, or other display. No additional manipulation, movements or steps are necessary, making this device easy and quick to affix to and remove from any product, and makes it re-usable.

The same procedure can be utilized for any object which the tag can fit over, around or through. These include, but are not limited to: plants and flowers, vases, hangers, eye glasses, stemware, mugs, giftware, toys, accessories, sundries, office products, etc.

As shown in FIGS. 1 through 8, the overall size and shape of the tag, the size and shape of the hole (14), the slit configuration (12) are determinate on the product to which this device is to be attached.

Conclusion, Ramifications and Scope

Thus the reader will see that this device provides an easy-to-affix and easy-to-remove, re-usable price/information device, tag or label. It can be hung from either side of the product with equal legibility. It is inexpensive to produce relative to other re-usable tags, comes pre-sorted in price order, and always appears next to the product it describes making it easy to read and identify. Once removed it does not leave any residue, is universal in size to work with a full range of products, and its placement does not cover up other pertinent information. Furthermore, this price tag is:

- Easy to affix to a product;
- Easy to remove from a product especially beneficial when tagging hundreds of items in a store, when trying on a product, when prices require changing, when taking inventory, when re-tagging for special events, or when an item is sold;
- Re-usable after being removed;
- Inexpensive to produce;
- Cost-effective to produce 2-sided to provide greater flexibility and visibility;
- Designed so that Pricing or Information appears very close to the product to which it relates, making price tag much more practical and easier to read and understand;
- Comes pre-sorted in sequential order making it quick and simple to locate the correct price/information for the product, cutting time and cost;
- Is neat, as the direction and orientation on how the tag will lay is predictable;
- No residue;
- Is universal in size to work with a wide range of products within a given group equally well, works with all styles of watches;
- Does not require a separate, additional apparatus or device to affix it;
- Can be printed in any color on any color suitable material;
- The information will not cover up other important information on the product's label.

Furthermore, as prototypes and sample production indicates, production of this tag versus the popular and widely-used "String Tag" is one-quarter (¼) the cost; and producing the tags 2 sided adds a minimal amount to the cost, not half again as much as is the case with String Tags.

While this above description contains many specificities, these should not be construed as limitations on the scope of the invention, but rather as an exemplification of one preferred embodiment thereof. Many other variations are possible. For example, the color, size and proportion can be changed to work with other products such as watches (the overall size would be larger, the body shorter in proportion and the hole large enough to fit over a watch band). It can be used by florists to show price and name of flower on stems of plants or foliage, (possibly utilizing a round hole shape, and constructed of cardboard or paperboard); and giftware could use the tag in any size or configuration which would fit the item and enhance its selling power while providing valuable information about the item to the consumer.

Thus the scope of the invention should be determined by the appended claims and their legal equivalents, rather than by the examples given.

I claim:

1. A tag providing product information in close proximity to said product comprising a main area where said information appears, an elongated cavity for said product, and a means at a narrow portion of said elongated cavity for said product to move into and out of said elongated cavity, whereby said main area is larger than said elongated cavity.

2. A tag of claim 1 wherein said main area is a means for displaying printed, foiled, inked, written, stamped or marked retail product information in close proximity to said product on one side or both sides.

3. A tag of claim 1 wherein said main area is printed, foiled, stamped or marked with Price information in close proximity to said product.

4. A tag of claim 1 wherein said main area is printed, foiled, stamped or marked with Sale, Value, Special, Now, Just, Discount Percent or Product Description.

5. A tag of claim 1 wherein said main area is made of a flat, thin material whereas the material is flexible and has a memory to return flat and will not break.

6. A tag of claim 1 wherein said tag is made of a flat, rigid, flexible, non-breakable, non-organic material as vinyl, plastic, or composite, or a known flat, rigid, flexible, non-breakable organic material.

7. A tag of claim 1 wherein said tag is resilient cardboard or paperboard material.

8. A tag of claim 1 wherein said tag is metal.

9. A tag to provide information in close proximity to a product comprising of an elongated hole to fit directly over and around said product, an access at a narrow portion of said elongated hole to accommodate movement of said product into said elongated hole, and a main body to accommodate retail product information.

10. A tag of claim 9 wherein said main area is a means for displaying retail product information which is printed, foiled, inked, written, stamped or marked in close proximity to said product on one side or both sides.

11. A tag of claim 9 wherein said main area is printed, foiled, stamped or marked with Price information.

12. A tag of claim 9 wherein said main area is printed, foiled, stamped or marked with Sale, Value, Special, Now, Just, Discount Percent or Product Description.

13. A tag of claim 9 wherein said main area is made of a flat, thin material whereas the material is flexible and has a memory to stay flat but will not break.

14. A tag of claim 9 wherein said tag is made of a flat, rigid, flexible, non-breakable, non-organic material as vinyl, plastic, or composite; or a known flat, rigid, flexible, non-breakable organic material.

15. A tag of claim 9 wherein said tag is resilient paperboard or cardboard material.

16. A tag of claim 9 wherein said tag is metal.

* * * * *